US009332821B2

(12) United States Patent
Janssen et al.

(10) Patent No.: US 9,332,821 B2
(45) Date of Patent: May 10, 2016

(54) LOAD CARRYING SYSTEM

(71) Applicant: Toto Carrying Systems B.V., Vinkeveen (NL)

(72) Inventors: Jeroen Marcellus Leonardus Janssen, Vinkeveen (NL); Stanley Maria Tjong San Sie, Amstelveen (NL)

(73) Assignee: Toto Carrying Systems B.V., Vinkeveen (NL)

( * ) Notice: Subject to any disclaimer, the term of this patent is extended or adjusted under 35 U.S.C. 154(b) by 0 days.

(21) Appl. No.: 14/399,924

(22) PCT Filed: Apr. 23, 2013

(86) PCT No.: PCT/NL2013/050300
§ 371 (c)(1),
(2) Date: Nov. 7, 2014

(87) PCT Pub. No.: WO2013/169100
PCT Pub. Date: Nov. 14, 2013

(65) Prior Publication Data

US 2015/0157114 A1 Jun. 11, 2015

(30) Foreign Application Priority Data

May 9, 2012 (NL) ..... 2008784

(51) Int. Cl.
*A45F 3/04* (2006.01)
*A45F 3/08* (2006.01)
*A45F 3/10* (2006.01)

(52) U.S. Cl.
CPC . *A45F 3/04* (2013.01); *A45F 3/047* (2013.01); *A45F 3/08* (2013.01); *A45F 3/10* (2013.01); *A45F 2003/045* (2013.01)

(58) Field of Classification Search
CPC ..... A45F 3/06; A45F 3/08; A45F 3/10; A45F 2003/045
USPC ..... 224/628, 633, 634, 636, 637
See application file for complete search history.

(56) References Cited

U.S. PATENT DOCUMENTS 4,015,759 A 4/1977 Dreissigacker et al.
4,298,149 A * 11/1981 Gottschalk ..... A45F 3/10 224/201

(Continued)

FOREIGN PATENT DOCUMENTS

AT 503417 B1 10/2007
DE 10033738 A1 1/2002

(Continued)

OTHER PUBLICATIONS

PCT International Search Report mailed on May 27, 2013 for PCT Application No. PCT/NL2013/050300 (5 pages).

*Primary Examiner* — Justin Larson
(74) *Attorney, Agent, or Firm* — Seed IP Law Group PLLC

(57) ABSTRACT

The invention relates to a load carrying system (1) to carry a load on the back of a human user, wherein the load carrying system (1) comprises a load carrier (10) for the load, two shoulder straps (17) connected with the load carrier (10) that go over the shoulders of the human user, a belt (3) to be secured around the abdomen just above the hips of the human user, and one elongated support (60) that connects the load support (10) with the belt (3), wherein the elongated support (60) has a width that is smaller than the width of the load support (10) and projects freely downwards from the load support (10) to form the sole weight transferring connection between the load support (10) and the belt (3) behind the back of the human user, wherein the elongated support (60) comprises a first bending section that allows displacement of the load support (10) with respect to the belt (3).

19 Claims, 9 Drawing Sheets

(56) References Cited

U.S. PATENT DOCUMENTS

| | | | | | |
|---|---|---|---|---|---|
| 4,479,595 | A * | 10/1984 | Opsal | A45F 3/047 | 224/630 |
| 4,911,346 | A * | 3/1990 | Shallman | A45F 3/08 | 224/153 |
| 4,982,884 | A * | 1/1991 | Wise | A45F 3/04 | 224/197 |
| 5,806,741 | A * | 9/1998 | Kirk | A45F 5/00 | 224/634 |
| 8,182,439 | B2 * | 5/2012 | Glenn | A45F 3/14 | 224/637 |
| 8,308,670 | B2 * | 11/2012 | Sandifer | A61F 5/026 | 224/263 |
| 8,991,671 | B2 * | 3/2015 | Gill | A45F 3/04 | 224/628 |
| 2008/0035686 | A1 * | 2/2008 | Gregory | A45F 3/10 | 224/262 |
| 2010/0076359 | A1 * | 3/2010 | Glenn | F41H 1/02 | 602/19 |
| 2011/0108595 | A1 * | 5/2011 | Hoag | A45F 3/10 | 224/633 |
| 2013/0283492 | A1 * | 10/2013 | Ernst, Jr. | A45F 3/04 | 2/44 |
| 2014/0151424 | A1 * | 6/2014 | Hexels | A45F 3/06 | 224/637 |
| 2014/0224849 | A1 * | 8/2014 | Hiemenz | A45F 3/04 | 224/271 |
| 2014/0305982 | A1 * | 10/2014 | Pelland | A45F 3/06 | 224/576 |
| 2015/0189974 | A1 * | 7/2015 | Bercaw | A45F 3/10 | 224/633 |

FOREIGN PATENT DOCUMENTS

| | | | |
|---|---|---|---|
| DE | 202008000644 | U1 | 4/2008 |
| EP | 1842449 | A1 | 10/2007 |

* cited by examiner

LOAD CARRYING SYSTEM

BACKGROUND

1. Technical Field

The present disclosure relates to a load carrying system to be carried on the back of a human user, comprising two shoulder straps that go over the shoulders of the human user and a belt to be secured around the abdomen just above the hips of the human user. The load carrying system can for example be embodied as a back pack.

2. Description of the Related Art

Known backpacks with a hip belt are used to carry a relatively heavy load, such as a full survival package. A substantial portion of the weight is transferred to the human body via the hip belt in order to unburden the back. Usually the belt forms a unity with the part of the backpack that rests against the back of the human user, whereby the human user experiences less comfort during bending or swinging his torso with respect to the hips.

BRIEF SUMMARY

Embodiments of the present invention provide a load carrying system of the abovementioned type that can be comfortably carried on the back of a human user.

More particularly, embodiments of the present invention provide a load carrying system to carry a load on the back of a human user, wherein the load carrying system comprises a load support for the load, two shoulder straps connected with the load support that go over the shoulders of the human user, a belt to be secured around the abdomen just above the hips of the human user, and one elongated support that connects the load support with the belt, wherein the elongated support has a width that is smaller than the width of the load support and projects freely downwards from the load support to form the sole weight transferring connection between the load support and the belt behind the back of the human user, wherein the elongated support comprises a first bending section that allows displacement of the load support with respect to the belt, wherein the first bending section has bending properties that depend on the bending direction of the elongated support substantially transverse to its longitudinal axis, wherein the first bending section has a first bending flexibility at bending in a first bending direction along with the human user with the torso moving forwards and backwards substantially parallel to the anatomic sagittal plane and a second bending flexibility substantially transverse to the first bending direction, wherein the first bending flexibility is higher than the second bending flexibility.

The elongated support forms the sole connection between the bag support and the belt behind the back of the human user, wherein the flexibility in the forward and backward bending direction allows the user to swing forwards and backwards again while the load is still carried by the hip area during swinging. Bending in the second bending direction may occasionally occur at bending along with the human user with the torso moving sideways substantially parallel to the anatomic coronal plane.

In a practical embodiment, the first bending flexibility is at least five times higher, preferably at least ten times higher than the second bending flexibility.

In a practical embodiment, the first bending section is dimensioned to be reversible flexible under transfer of a weight from the load support to the belt of at least ten kilograms, preferably at least twenty kilograms. This means that the elongated support does not buckle or plastically deforms under this condition.

In an embodiment, the elongated support extends in the anatomic sagittal plane, wherein the first bending section comprises a curvature having the concave side facing the load support and the belt. The curvature ensures that the elongated support remains spaced apart from the back of the human user when he stands straight, for example during walking with the load. This carries comfortable.

In an embodiment, the first bending section comprises a series of narrowings that form living hinges that extend transverse to the longitudinal direction of the elongated support. Living hinges form local bending areas that due to their direction provide the differences in flexibility according to embodiments of the invention, while the adjacent parts provide the capability to transfer a part of the weight of the bag to the belt.

In an embodiment thereof, the first bending section comprises a series of vertebrae forming rigid bodies that are connected to each other by means of the living hinges. In this manner the first bending section can behave as the human back itself, thereby forming a second backbone to unburden the backbone of the human user.

In an embodiment thereof, the vertebrae comprise a projection that extends over the living hinge to the adjacent vertebra, and a recess to receive and support the distal end of the projection of the adjacent vertebra. The received projection transfers a portion of the weight to be carried by the first bending section, thereby unburden the living hinge that is bridged by the projection. The living hinge is thereby loaded fully only when the projection is out of the recess, which is only when the human user bends forwards.

In an embodiment, the first bending section is formed as one unity or mono-piece, whereby it can be made of the same material by injection molding.

In an embodiment thereof, the first bending section is made of a rigid plastic.

In an embodiment, the elongated support comprises a second bending section in series with the first bending section, wherein the second bending section is located at the side of the belt and allows a swinging movement of the belt with respect to the first bending section. The distinct second bending section forms the lower part of the connection between the bag support and the belt to have dedicated properties for transferring the weight from the first bending section to the belt.

In an embodiment thereof, the first bending section is configured to substantially fully transfer a twist between the load support and the belt around the longitudinal axis of the elongated support to the second bending section, wherein the second bending section is configured to substantially fully absorb this transferred twist. It has been found that the dedicated direction sensitive reversible flexing of the elongated support at the side of the load carrier and the dedicated absorption of the twist of the elongated support at the side of the belt ensures comfortably carrying of the load even when moving the torso with respect to the hip.

In a practical embodiment, the elongated support has in the longitudinal direction of the first bending section at least twice the length of the second bending section.

In an embodiment, the second bending section has flexibility properties that differ from the flexibility properties of the first bending section.

In an embodiment thereof, the second bending section has bending properties that depend on the bending direction of the elongated support substantially transverse to its longitudinal axis, wherein the second bending section has a third bending flexibility at bending in the first bending direction along with the human user in the sagittal plane and a fourth bending flexibility substantially transverse to the first bending direction.

In an embodiment thereof, the fourth bending flexibility is higher than the third bending flexibility, whereby the second bending portion can compensate for the higher flexibility of the first bending portion at bending of the human user forwards and backwards and the second bending portion can compensate for the lower flexibility of the first bending portion at bending or swinging sideways of the human user.

In an embodiment thereof, the second bending section comprises at least one narrowing that forms a living hinge.

In an embodiment, the second bending section is formed as one unity or mono-piece.

In an embodiment, the first bending section and the second bending section are made of different materials, each having material properties that are dedicated for the transfer of the weight to the belt under movement of the human user.

In an embodiment, the second bending section is made of rubber or a flexible material that behaves as rubber.

In an embodiment, the load support comprises a rail and a runner that is moveable along the rail, wherein the elongated support is connected with the runner to change the distance between the load support and the belt. By means of the runner the distance can be adapted to the specific dimensions of the human user in order to assure that a substantial portion of the weight is transferred to the belt via the elongated support.

In an embodiment thereof, the movement of the runner along the rail in the direction that reduces the distance between the load support and the belt is limited to a first position of the runner by an abutment that is positioned at the rail to come into abutment with the runner. The abutment sets the dedicated distance for the human user in which the weight is optimally transferred to the belt.

In an embodiment, the runner is movable along the rail between the first position and a second position wherein the distance between the load support and the belt is larger than in the first position, which allows the elongated support to enlarge the distance between the load support and the belt during deep forward bending of the user.

In an embodiment, the load carrying system comprises an elastic cable or spring that is connected with the runner to bias the runner to the first position, whereby the abutted position of the runner is ensured.

In an embodiment, the abutment forms part of a slider that is connected with a first rope to slidably adjust the first position, wherein the opposite end of the first rope extends outside the load support. The human user is thereby capable to grab the first rope and to adjust the position of the abutment to the position that suits him most.

In an embodiment, the load carrying system comprises a brake for the first rope that fixates the rope with respect to the bag support, wherein the brake is biased to its active position, wherein the load carrying system preferably comprises a second rope that is connected with the brake to release the brake by pulling the second rope with respect to the load support, wherein the opposite end of the second rope extends outside the load support. The human user is capable to release the brake by pulling the second rope, whereby the distance between the load support and the belt can be quickly reduced to facilitate taking off the load carrying system. In this compact mode the load carrying system can be transported more easily as well.

In an alternative, more basic embodiment the abutment forms part of a fixation block having a fixated position with respect to the rails.

In an embodiment, the load support comprises a bag to contain the load, whereby the load carrying system is configured as a backpack.

The various aspects and features described and shown in the specification can be applied, individually, wherever possible. These individual aspects, in particular the aspects and features described in the attached dependent claims, can be made subject of continuation or divisional patent applications.

BRIEF DESCRIPTION OF THE SEVERAL VIEWS OF THE DRAWINGS

The invention will be elucidated on the basis of an exemplary embodiment shown in the attached drawings, in which.

DETAILED DESCRIPTION

Figure 1:
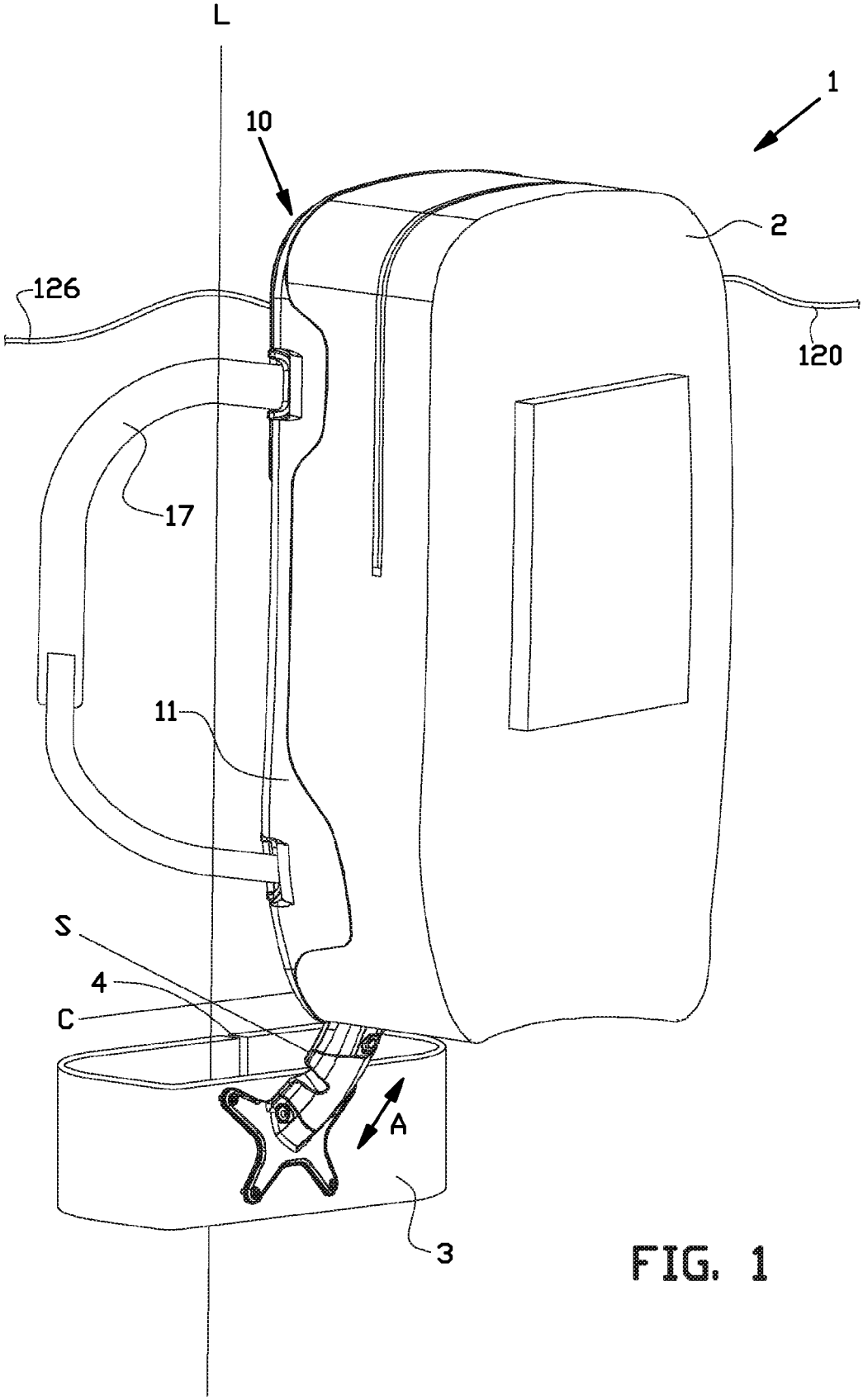
FIG. 1 shows a load carrying system according to an embodiment of the invention, that is embodied as a backpack, comprising a carrier with an elongated support.

FIG. 1 shows a load carrying system according to an example embodiment of the invention, which is dimensioned to carry a load on the back of a human user. In FIG. 1 the load carrying system is embodied as a backpack 1. In this embodiment, the load is a bag 2 that is connected with a carrier 10 of the load carrier. In this example, the bag 2 and the carrier 10 form two distinct parts, but alternatively the carrier 10 forms an integral part with the load. According to one or more embodiments of the invention, the load is not limited to a bag 2 but any kind of load may be applicable, such as a mobile device or machine to be carried on a human back.

Figure 2:
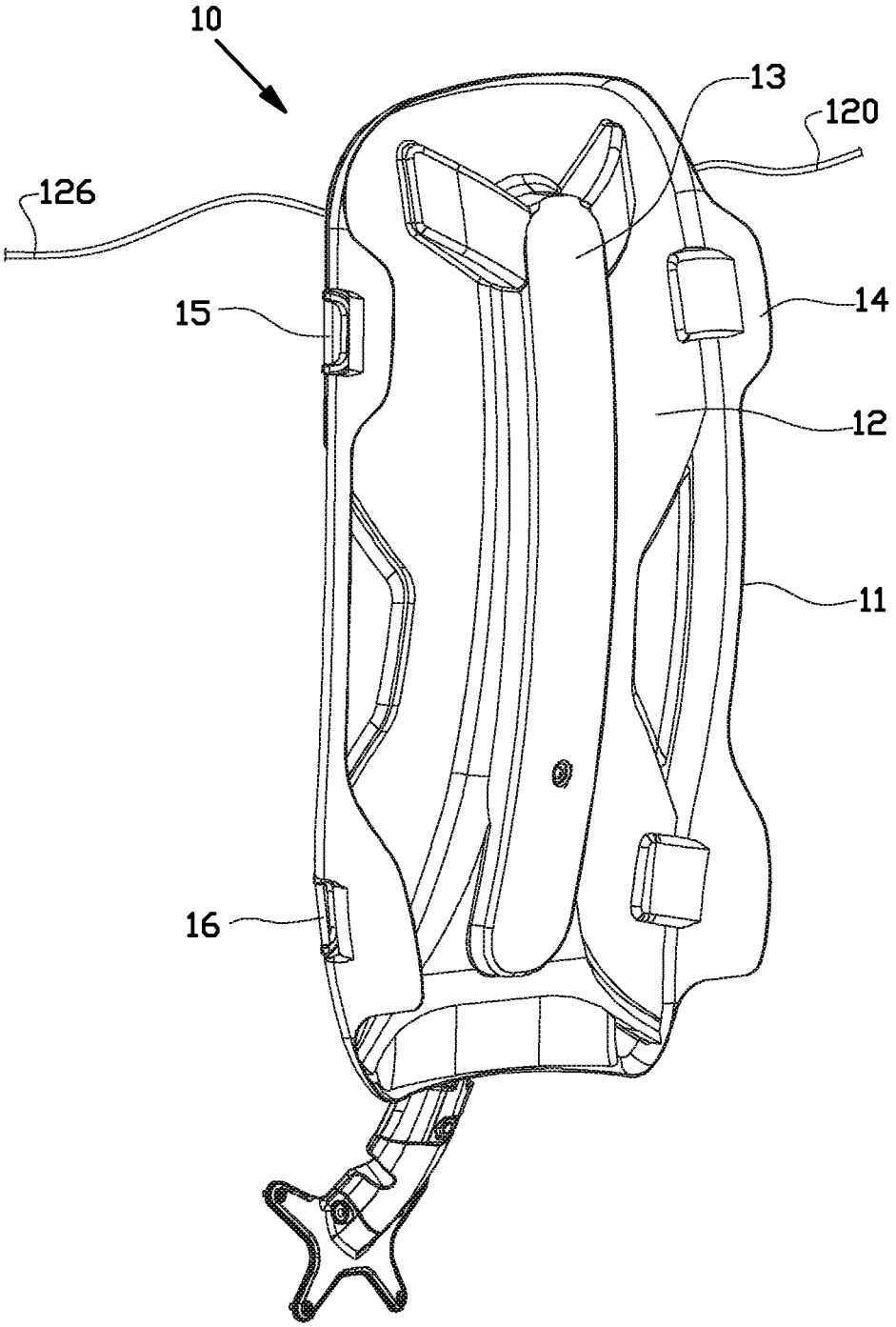
FIGS. 2 and 3 show the back side and the front side of the carrier and the elongated support according to FIG. 1.

As also shown in FIG. 2, the carrier 10 comprises a form stable plastic load support 11 having a substantially constant wall thickness. The load support 11 comprises a base 12 that merges into an elongated recessed portion 13 within the base 12, and a circumferential wall 14 around the base 12 to partly enclose one side of the bag 2. The base 12 and the elongated recessed portion 13 are both slightly curved. At the outer circumference two upper eyes 15 and two lower eyes 16 are provided to connect two shoulder straps 17 that go over the shoulders of the human user of the backpack 1.

Figure 3:
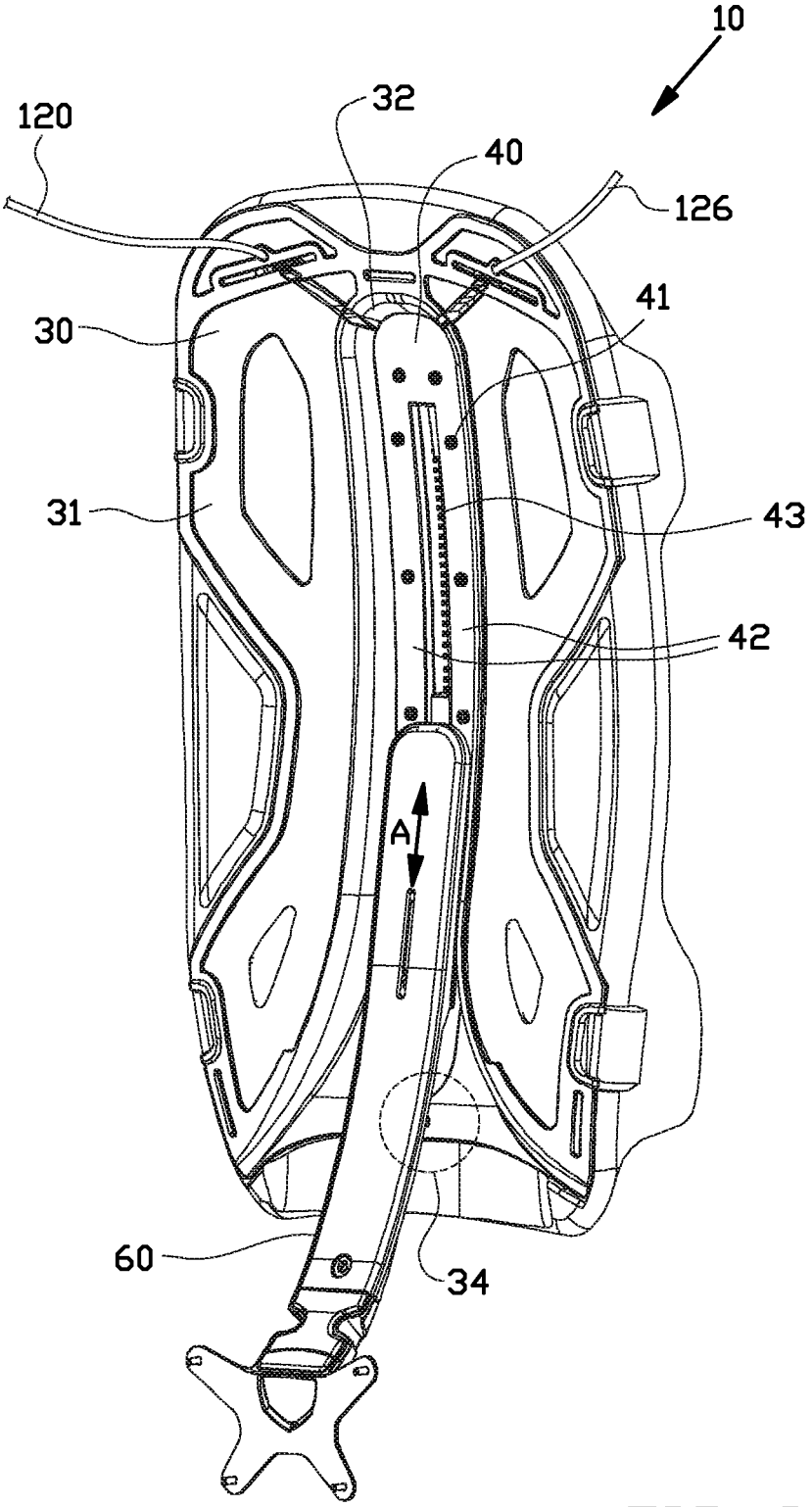
Figure 6:
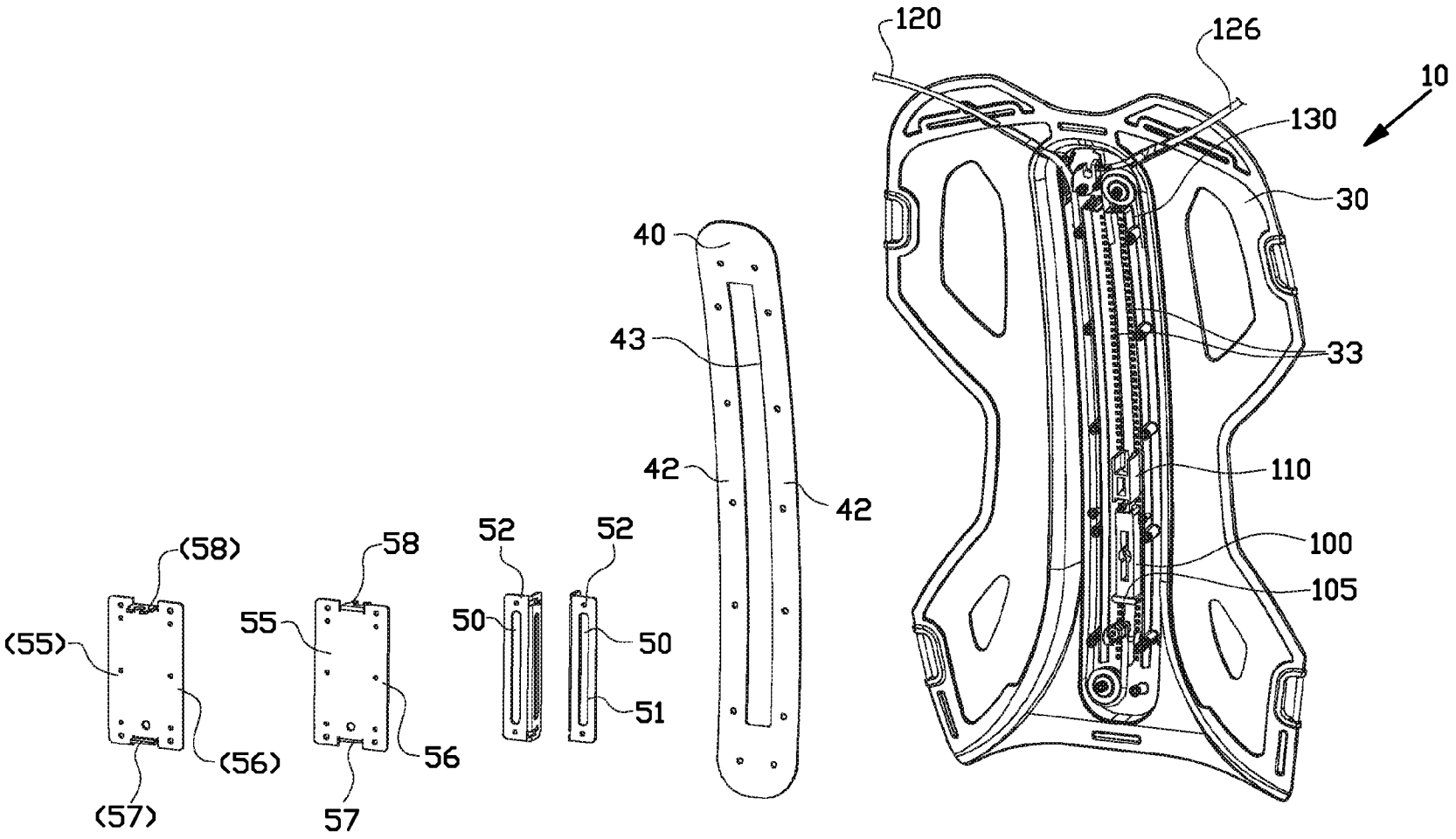

As shown in FIGS. 3 and 6 the carrier 10 comprises a form stable plastic frame 30 having a substantially constant wall thickness. The frame 30 comprises a base 31 that merges into a gutter 32. The base 31 has slightly the form of an eight around the gutter 32 and supports the base 12 of the bag support 11, wherein the gutter 32 is inserted into the recessed portion 13 of the bag support 11.

As shown in FIGS. 3 and 6 the carrier 10 comprises an elongated metal slide plate 40 that has been mounted at a recessed position which is at about half the depth of the gutter 13. The slide plate 40 and the parts associated therewith have been shown separately and reversed in FIGS. 7A and 7B. The frame 30 is provided with bushes 33 inside the gutter 32 that support the slide plate 40, wherein the slide plate 40 is secured by means of bolts 41 that are screwed into the bushes 33. The slide plate 40 has a slight curvature to follow the curvature of the gutter 32. The slide plate 40 comprises an elongated slot 43 whereby two opposite slide rails 42 are defined.

Figure 7A:
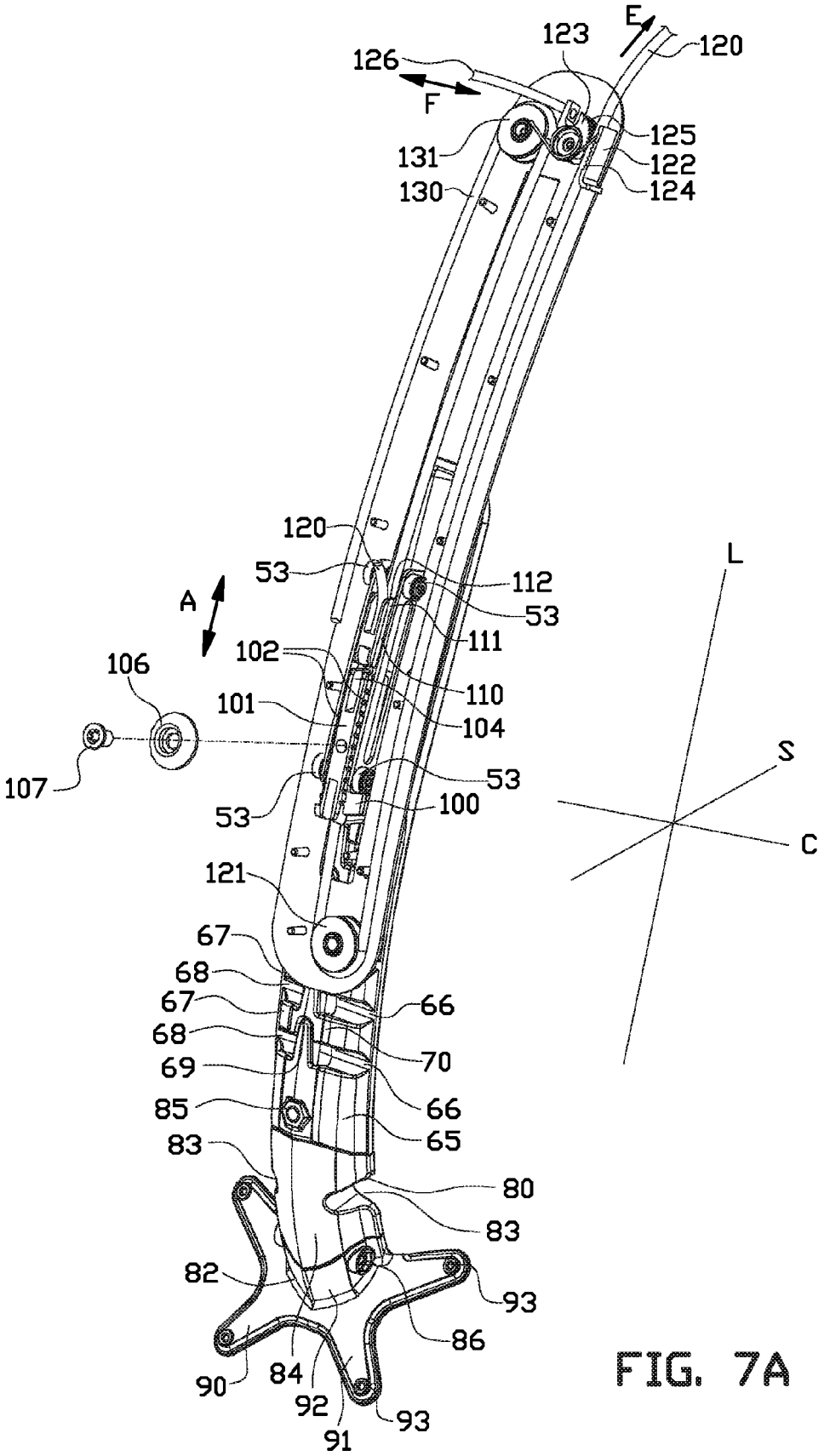
FIG. 7A show the elongated support according to FIG. 3 reversed and the inner parts of its adjustment.
Figure 7B:
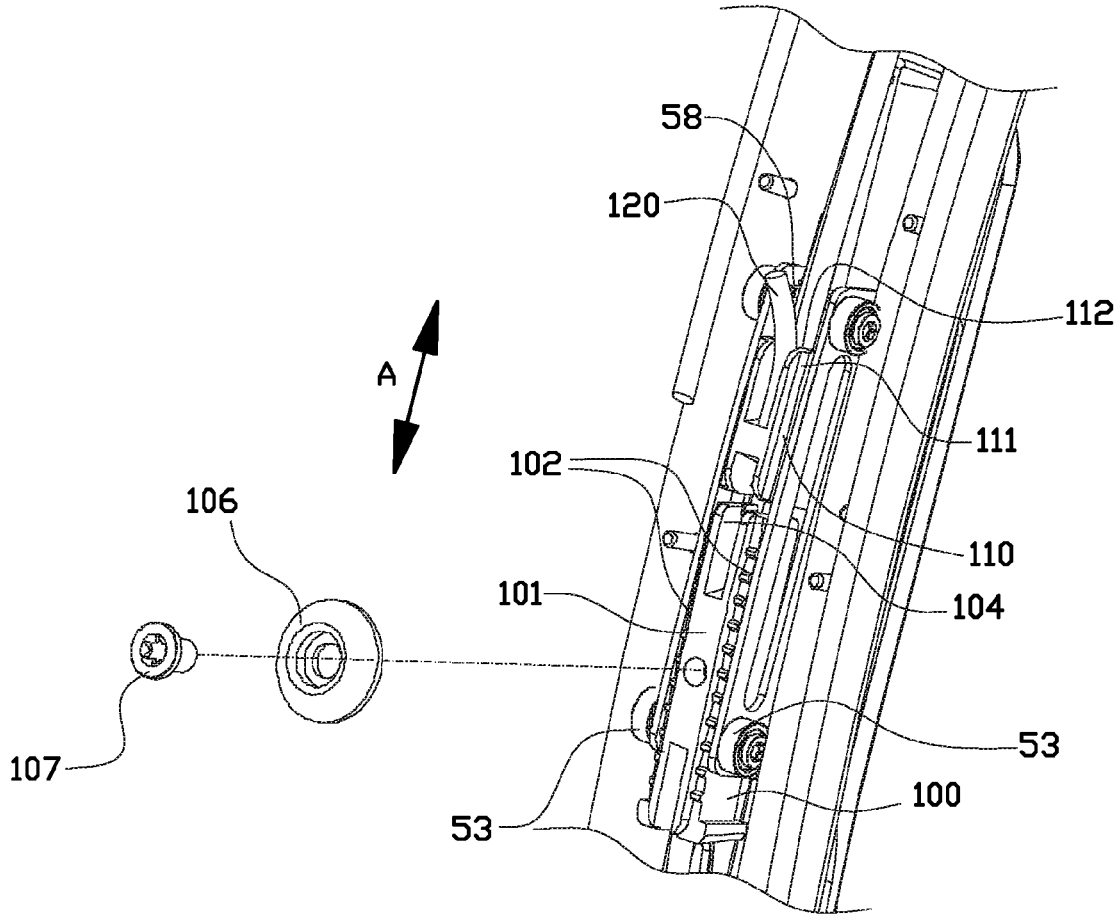
FIG. 7B show details of the inner parts of FIG. 7A.

As shown in FIGS. 6 and 7A the carrier 10 comprises two metal runners 50 having a first limb 51 that extend above the front side of the slide rails 42 and a second limb 52 that is inserted into the elongated slot 43 of the slide plate 40. The runners 50 each comprise two rollers 53 on the second limb 52 that are rotatably confined between the slide rails 42 and the bottom of the gutter 32. As shown in FIG. 6 the first limbs 51 of the runners 50 are both mounted to a metal mounting plate 55 that keeps the runners 50 at a fixed mutual distance. In this manner the runners 50 and the mounting plate 55 form a unity that can smoothly run in direction A along the length of the elongated slot 43. FIG. 6 shows the mounting plate 55 both in its mounted orientation and reversed to show the opposite side thereof. The mounting plate 55 comprises a straight, rectangular base plate 56 and a first lip 57 and a longer second lip 58 that when mounted both project through the elongated slot 43.

Figure 4:
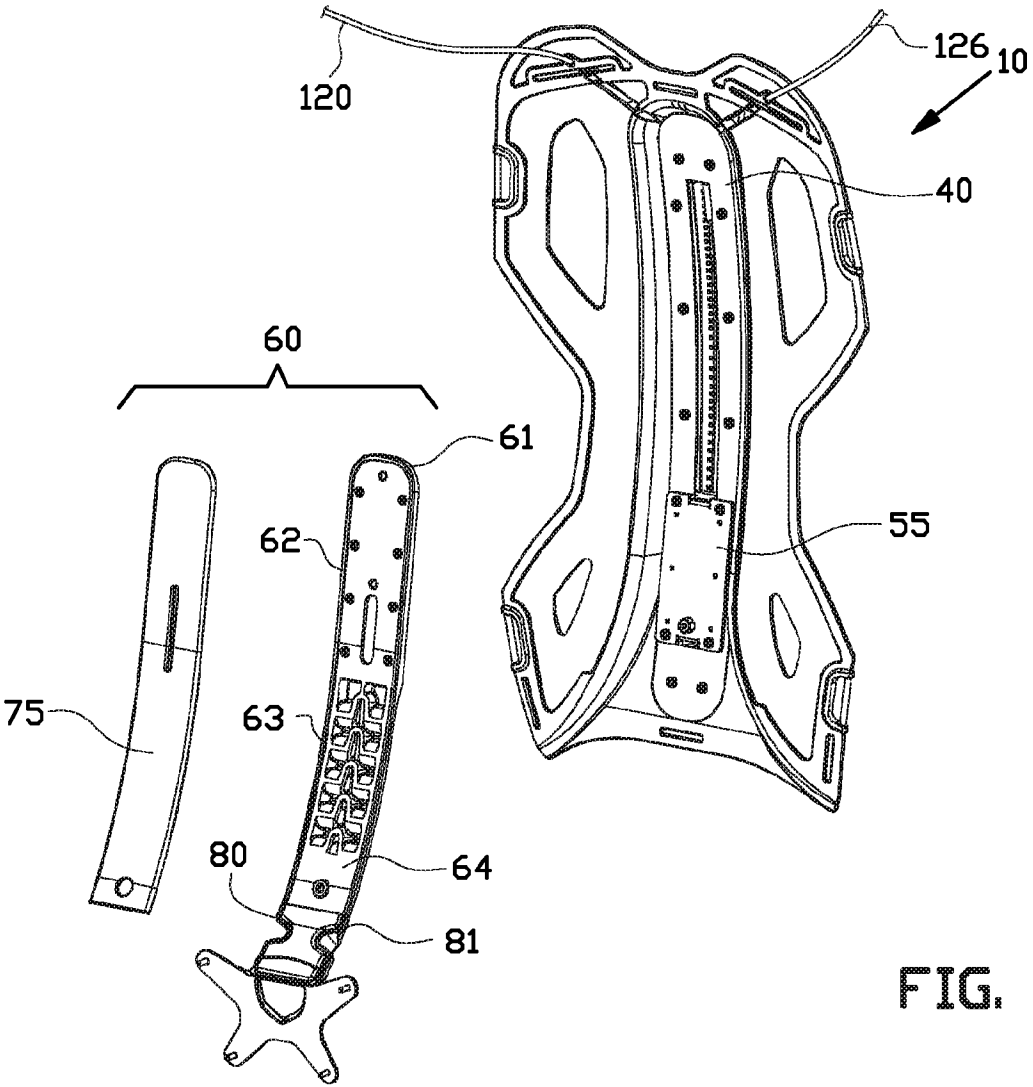
FIGS. 4-6 are partly exploded views of the carrier and the elongated support according to FIG. 3.
Figure 5:
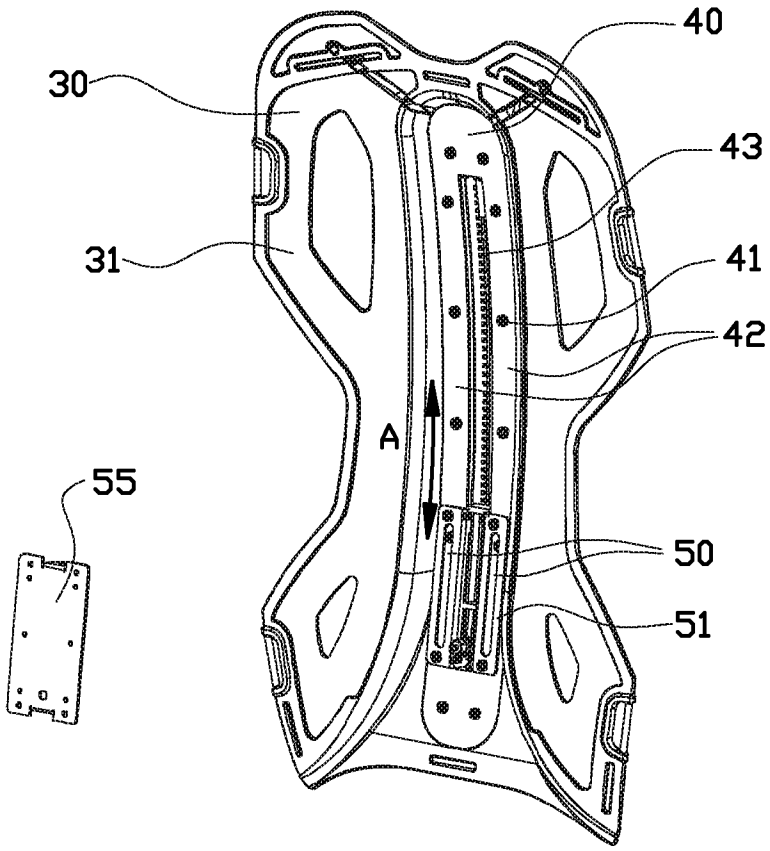

As shown in FIGS. 3 and 4 the carrier 10 comprises an elongated support 60 having a slight curvature in accordance with the curvature of the gutter 32. At the upper end the elongated support 60 is mounted on the mounting plate 55. At the lower end the elongated support 60 is connected to a flexible belt 3. The belt 3 comprises a front closure 4 and is configured to be clasped around the human abdomen, just above the hips. FIG. 1 schematically illustrates the main axes of a standing human body when the backpack 1 is carried on the back. Axis L illustrates the anatomic longitudinal axis of the human body that extends substantially vertically. Perpendicularly oriented axis L and axis C together define the anatomic coronal plane of the human body. Perpendicularly oriented axis L and S together define the anatomic sagittal plane of the human body. Perpendicularly oriented axis C and S together define the traverse plane of the human body.

As shown in FIGS. 4 and 7A the elongated support 60 comprises a form stable plastic backbone 61 comprising in series a mounting part 62 that merges into a backbone part 63. The backbone part 63 is formed as one piece with a constant wall thickness. In this embodiment the backbone part 63 has a flat front surface 64 and a substantially semi oval outer back surface 65. At the back side apertures 66 have been formed having curved inner surfaces that at the top sides merge into the back surface 65. At the bottom the apertures 66 define a series of transversely extending plastic living hinges 68 having the same wall thickness as the remainder of the backbone part 63. The apertures 66 furthermore define a series of vertebrae 67 each having a projection 69 that can freely move into and out of a recess 70 in its adjacent vertebrae 67 when the living hinges 68 are bent. In this manner the backbone part 61 has some flexibility when bending substantially parallel to the sagittal plane and has less flexibility or is at least ten times stiffer when bending substantially parallel to or in the coronal plane, which flexibility and stiffness is provided by the plastic material itself in combination with the form of the backbone part 63.

The flat side of the a mounting part 62 and the backbone part 63 of the backbone 61 are covered with an elongated, flat plastic cover 75 that is able to follow abovementioned flexions. Due to said directional differences in flexibility the backbone 61 enables a reversible, reciprocal movement of the belt 3 towards and away from the frame 30 in the sagittal plane. The backbone 61 is dimensioned to transfer a weight from the frame 30 to the belt 3 of more than 20 kilograms in its longitudinal direction while flexing in the reversible manner, that is, without buckling under plastic deformation of the living hinges 68. Due to its shape the backbone part 63 hardly wrenches when a torque around the longitudinal axis is applied to its opposite ends.

In this embodiment, the backbone part 63 comprises a series of vertebrae 67. However, abovementioned directional dependent flexibility differences and torsion properties can be obtained in many different ways, such as by a flat plate or strip having the slight curvature.

As shown in FIG. 4 the elongated support 60 comprises a flexible joint 80 that is mounted to the backbone part 63. The flexible joint 80 is made of rubber and has a flat front surface 81 and a substantially semi oval back surface 82 that form continuations of the front surface 64 and the back surface 65 of the backbone part 63. At the opposite sides two apertures 83 define a narrowed portion 84 of the joint 80. At the upper side the joint 80 comprises an insert section that is inserted in an insert channel of the backbone part 63 and locked by a bolt 85. At the lower side the joint 80 comprises an insert section to connect the flexible joint 80 to a plastic bracket 90. Alternatively the flexible joint 80 is embodied as a ball and socket joint.

The bracket 90 comprises a mounting plate 91 having four fingers that are connected to the back side of the belt 3 by means of screws 93, and a central insert channel 92 wherein the lower insert section of the flexible joint 80 is inserted and secured by means of a bolt 86. The narrowed portion 84 of the joint 80 allows the backbone part 63 to be moved with respect to the belt 3 substantially parallel to the coronal plane with more flexibility than substantially parallel to the sagittal plane. The flexible joint 80 is able to reversible absorb twists between the frame 30 and the belt 3 around the curved longitudinal axis of the elongated support 60.

As shown in FIGS. 1, 3 and 7A the distance between the belt 3 and the base 12 of the bag support 11 is adjustable in direction A by means of a mechanism that is described in the following paragraphs.

The carrier 10 comprises a plastic fixation block 100 having an elongated rectangular body 101 with a longitudinal inner channel 104 that is open along its length at the side that faces away from the gutter 32. The fixation block 100 comprises two rows of teeth 102 that interlock with two rows of teeth 33 that extend over the full length of the bottom of the gutter 32. The interlocked position of the fixation block 100 is secured by means of a rosette 106 against the opposite side of the bottom of the gutter 32 and a screw 107 that is inserted in the rosette 106 and screwed through the bottom of the gutter 32 into a threaded hole 103 of the rectangular body 101. At the side that faces the slide plate 40 the fixation block 100 comprises a projecting abutment edge 105.

The carrier 10 furthermore comprises a plastic slide block 110 comprising a rectangular body 111 with a longitudinal inner channel 112 that is open along its length at the side that faces away from the gutter 32. The slide block 110 is able to slide downwards to come into abutment with the end of the rectangular body 101 of the fixation block 100. The first lip 57 of the mounting plate 57 is located between the abutment edge 105 and the front face of the slide block 110 that faces the fixation block 100. When the slide block 110 is in abutment with the fixation block 100, the first lip 57 can only make a stroke over the rectangular body 111, which stroke is limited by the upwardly projecting abutment 105 and the upwardly projecting face of the slide block 110. The slide block 110 is always reciprocally moveable confined between the first lip 57 and the second lip 58.

The slide block 110 is connected to a first rope 120 that runs downwardly through the inner channel 104 of the fixation block 100 and between the runners 50, and subsequently back upwards via a first reel 121 on the slide plate 40 to be confined between a break plate 122 that is fixed onto the slide plate 40 and a rope clamp 123 that is hingeably connected to the slide plate 40. The break plate 122 is provided with a straight row of teeth 124 and the rope clamp 123 is provided with a curved row of teeth 125.

The rope clamp 123 can swing and is spring biased to a squeezing position to clamp the rope. In this clamped condition the rope can only pass in upward direction E. The rope clamp 123 is connected to a second rope 126 to swing the rope clamp 123 against the bias when pulled in direction F to release the squeezing rope clamp 123 whereby the first rope 120 is able to move backwards.

The second lip 58 of the mounting plate 55 is connected to an elastic cable 130 that runs upwards through the inner channel 104 of the fixation block 100 and subsequently back downwards via a second reel 131 on the slide plate 40 to be connected to the lower end of the slide plate 40. The elastic cable 130 is biased to urge the slide block 110 and thereby the mounting plate 55 and the runners 50 fully upwards to the upper end of the elongated slot 43 and it allows the slide block 110 to be pulled to the lower end of the elongated slot 43 by means of the first rope 120.

The adjustment of the distance between the belt 3 and the base 12 of the bag support works as follows:

The optimal height on which the straight upright standing human user needs to carry the bag support 11 against his back determines the optimal distance between the bag support 11 and the belt 3 to be set once. This carrying distance determines the load carrying length of the portion of the elongated support that projects downwards from the bottom side of the bag support 11. This load carrying length corresponds with a determined position of the first lip 57 in the longitudinal direction of the slide plate 40. The fixation block 100 is thereby mounted such that the slide block 110 is both in abutment with the fixation block 100 and the first lip 57.

The runners 50 can run fully upwards in direction A under the bias of the elastic cable 130. The slide block 110 remains slidably confined between the first lip 57 and the second lip 58 of the mounting plate 55. This run is triggered by pulling the second rope 126 in direction F, whereby the first rope 120 that is attached to the slide block 110 is released and the slide block 110 is pushed upward by the abutting first lip 57. In this position the lower side of the belt 3 extends at the level of the bottom of the bag 2 whereby the backpack 1 can stably stand on a floor in the same orientation as when carried on the back. This is the retracted condition of the back pack 1, which also allows easy transport of the back pack 1 when it is not carried on the back but stowed for example.

Immediately after the user has hung the retracted back pack 1 on his back by means of the carrying straps 17, he clasps the belt 3 and pulls firmly on the first rope 120 until the slide block 120 has come into abutment with the fixation block 100. During this movement the runners 50 are pushed down by the slide block 110 that engages the first lip 57. The weight of the back pack 1 is then partly carried by the belt 3 at the hip area of the user. This part of the weight is further transferred via the tensioned first rope 120 to the rope clamp 123. Due to its curvature the elongated support 60 is kept over its full length at a free distance from the back of the user. The weight that is transferred via the elongated support 60 urges an increase of the curvature in the reversible elastic bending range of the elongated support 60. The elongated support 60 does not buckle irreversibly or plastically under this weight. The elongated support 60 extends freely from the frame 30, however a spot contact with the frame 30 or the bag support 11 at a lower area 34 thereof is possible.

In use, when the standing human user swings his shoulders with respect to his hips around his longitudinal axis L the backbone 61 maintains its biased curvature and keeps the flexible joint 80 straight down the frame 30. The backbone 61 transfers the twisting interaction between the frame 30 and the belt 2 substantially fully to the flexible joint 80 that substantially fully absorbs the rotation differences between the belt 3 and the lower side of the backbone 61. In this manner the frame 30 and the backbone 61 form one unity that swings above the flexible joint 80.

In use, when the user bends forward, the backbone 61 firstly elastically flexes back to its original curvature. Subsequently the runners 50 are allowed to freely run downwards within their limited stroke, as the first lip 57 is allowed to slide over the fixation block 100 towards the abutment edge 105. The first lip 57 comes back in abutment again with the slide block 110 when the human user subsequently straightens his back.

When the user takes off the backpack 1 he opens the belt 3 and pulls the second rope 126 in direction F whereby the first rope 120 is released. The biased elastic cable 130 can pull the runners 50 upwards. During this movement the first lip 57 remains in abutment with the slide block 110 and hauls in the first rope 120.

Figure 8:
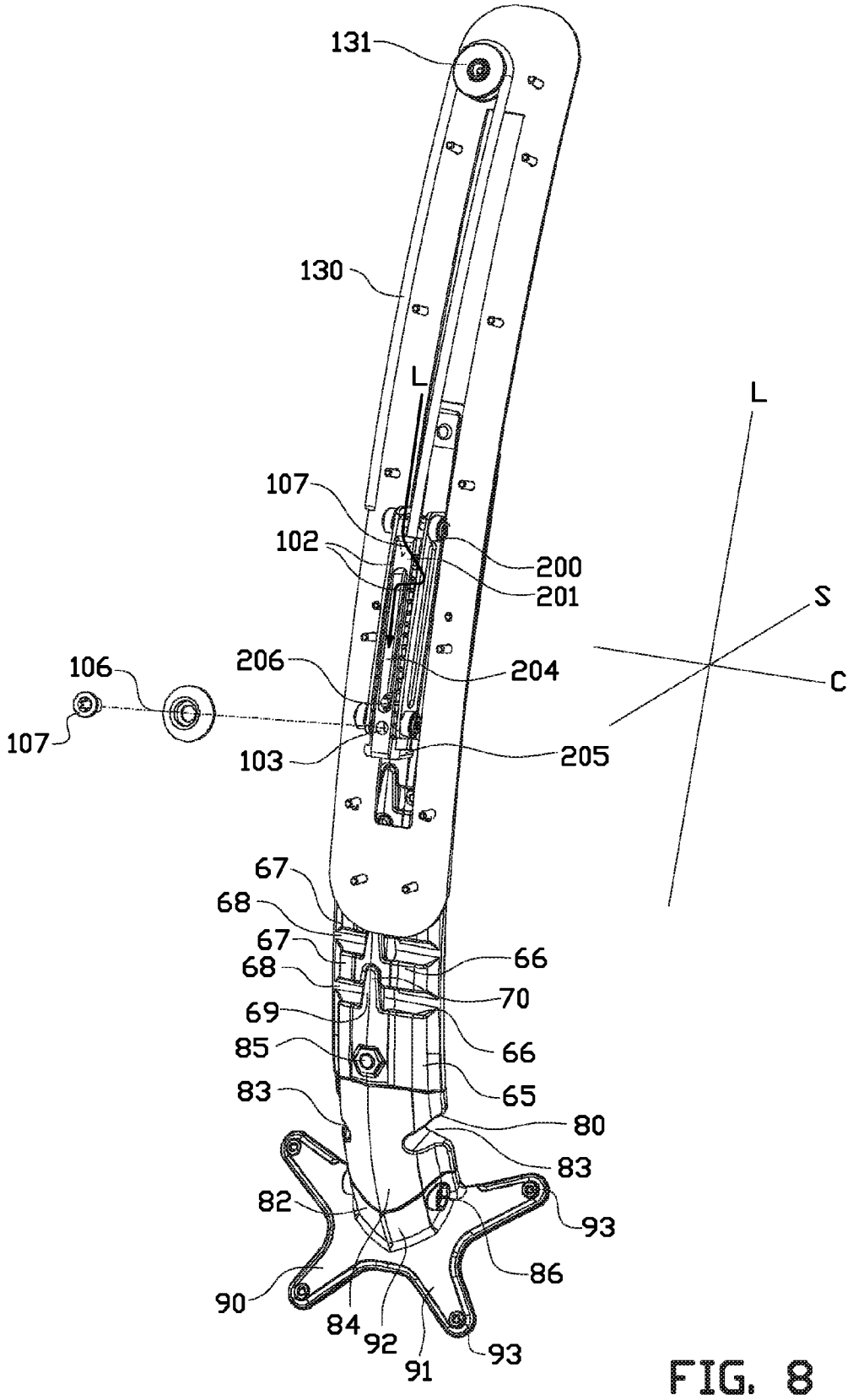
FIG. 8 show the elongated support according to FIG. 3 reversed and an alternative embodiment of the inner parts of its adjustment.

FIG. 8 shows an alternative adjustment mechanism for the elongated support 60. The parts that correspond with the mechanism as described before are provided with corresponding reference numbers.

The alternative adjustment mechanism comprises a fixation block 200 having an elongated rectangular body 201 with a longitudinal inner channel 204. A retractable pin 206 that projects from the mounting plate 55 is slidably confined into the inner channel 204 to limit the movement of the runners 50 with respect to the fixation block 200. The pin 206 is biased to its locking position and the fixation block 200 comprises an oblique run off surface 107 that urges the end of the pin 206 to irreversibly enter the inner channel 104 according to a locking course G. The fixation block 200 comprises the two rows of teeth 102 that interlock with the two rows of teeth 33 in the gutter. The interlocked position of the fixation block 200 is secured by means of the rosette 106. The fixation flock 200 also has two abutment edges 205 that project far enough to come fully into abutment with the lower edges of the second limbs 52 of the runners 50. The fixation block 200 is mounted such in accordance with abovementioned needs of the user that the pin 206 is in abutment with the upper end of the inner channel 204 to transfer the weight to the belt 3. The biased elastic cable 130 keeps the pin 206 into abutment with the upper end of the inner channel 204, which abutment is only temporally released when the user bends forwards. During this forward bending the pin 206 is moved downwards through the inner channel 204 and moves back again.

The plastic material of the frame 30 and the elongated support is preferably Polyoxymethyleen (POM), polyamide nylon (PA nylon) or a fiber reinforced polyester, which provides sufficient form stability when subjected to a bending load.

It is to be understood that the above description is included to illustrate the operation of embodiments and is not meant to limit the scope of the invention. From the above discussion, many variations will be apparent to one skilled in the art that would yet be encompassed by the spirit and scope of the present invention.

The invention claimed is:

1. A load carrying system to carry a load on the back of a human user, the load carrying system comprising:

a load support for the load;

two shoulder straps connected with the load support that go over the shoulders of the human user;

a belt to be secured around the abdomen just above the hips of the human user; and one elongated support that connects the load support with the belt, wherein the elongated support has a width that is smaller than a width of the load support and projects freely downwards from the load support to form a sole weight transferring connection between the load support and the belt behind the back of the human user, wherein the elongated support comprises a first bending section that allows displacement of the load support with respect to the belt, wherein the first bending section has bending properties that depend on a bending direction of the elongated support substantially transverse to a longitudinal axis of the elongated support, wherein the first bending section has a first bending flexibility at bending in a first bending direction along with the human user with the torso moving forwards and backwards substantially parallel to the anatomic sagittal plane of the human user and a second bending flexibility substantially transverse to the first bending direction, and wherein the first bending flexibility is greater than the second bending flexibility, and wherein the first bending section comprises a series of narrowings that form living hinges that extend transverse to the longitudinal direction of the elongated support.

2. The load carrying system according to claim 1, wherein the first bending flexibility is at least five times greater than the second bending flexibility.

3. The load carrying system of claim 1 wherein the first bending section comprises a series of vertebrae forming rigid bodies that are connected to each other via the living hinges.

4. The load carrying system according to claim 3, wherein the vertebrae comprise a projection that extends over the living hinge to the adjacent vertebra, and a recess to receive and support the distal end of the projection of the adjacent vertebra.

5. The load carrying system according to claim 1, wherein the first bending section is formed as one unity or monopiece.

6. The load carrying system according to claim 5, wherein the first bending section is made of a rigid plastic.

7. A load carrying system to carry a load on the back of a human user, the load carrying system comprising:

a load support for the load;

two shoulder straps connected with the load support that go over the shoulders of the human user;

a belt to be secured around the abdomen just above the hips of the human user; and one elongated support that connects the load support with the belt, wherein the elongated support has a width that is smaller than a width of the load support and projects freely downwards from the load support to form a sole weight transferring connection between the load support and the belt behind the back of the human user, wherein the elongated support comprises a first bending section that allows displacement of the load support with respect to the belt, wherein the first bending section has bending properties that depend on a bending direction of the elongated support substantially transverse to a longitudinal axis of the elongated support, wherein the first bending section has a first bending flexibility at bending in a first bending direction along with the human user with the torso moving forwards and backwards substantially parallel to the anatomic sagittal plane of the human user and a second bending flexibility substantially transverse to the first bending direction, wherein the first bending flexibility is greater than the second bending flexibility, wherein the elongated support comprises a second bending section in series with the first bending section, and wherein the second bending section is located at the side of the belt and allows a swinging movement of the belt with respect to the first bending section.

8. The load carrying system according to claim 7, wherein the second bending section has flexibility properties that differ from flexibility properties of the first bending section.

9. The load carrying system according to claim 7, wherein the second bending section comprises at least one narrowing that forms a living hinge.

10. The load carrying system according to claim 7, wherein the second bending section is formed as one unity or monopiece.

11. The load carrying system according to claim 7, wherein the first bending section and the second bending section are made of different materials.

12. The load carrying system according to claim 7, wherein the second bending section has bending properties that depend on the bending direction of the elongated support substantially transverse to the longitudinal axis of the elongated support, and wherein the second bending section has a third bending flexibility at bending in the first bending direction along with the human user in a sagittal plane of the human user and a fourth bending flexibility substantially transverse to the first bending direction.

13. The load carrying system according to claim 12, wherein the fourth bending flexibility is greater than the third bending flexibility.

14. A load carrying system to carry a load on the back of a human user, the load carrying system comprising:

a load support for the load;

two shoulder straps connected with the load support that go over the shoulders of the human user;

a belt to be secured around the abdomen just above the hips of the human user; and one elongated support that connects the load support with the belt, wherein the elongated support has a width that is smaller than a width of the load support and projects freely downwards from the load support to form a sole weight transferring connection between the load support and the belt behind the back of the human user, wherein the elongated support comprises a first bending section that allows displacement of the load support with respect to the belt, wherein the first bending section has bending properties that depend on a bending direction of the elongated support substantially transverse to a longitudinal axis of the elongated support, wherein the first bending section has a first bending flexibility at bending in a first bending direction along with the human user with the torso moving forwards and backwards substantially parallel to the anatomic sagittal plane of the human user and a second bending flexibility substantially transverse to the first bending direction, wherein the first bending flexibility is greater than the second bending flexibility, wherein the load support comprises a rail and a runner that is moveable along the rail, and wherein the elongated support is connected with the runner to change the distance between the load support and the belt.

15. The load carrying system according to claim 14, wherein the movement of the runner along the rail in a direction that reduces the distance between the load support and the belt is limited to a first position of the runner by an abutment that is positioned at the rail to come into abutment with the runner.

16. The load carrying system according to claim 15, wherein the runner is movable along the rail between the first position and a second position wherein the distance between the load support and the belt is larger than in the first position, and wherein said load carrying system further comprises an elastic cable or spring that is connected with the runner to bias the runner to the first position.

17. The load carrying system according to claim 15, wherein the abutment forms part of a slider that is connected with a first rope to slidably adjust the first position, and wherein an opposite end of the first rope extends outside the load support.

18. The load carrying system according to claim 17, further comprising a brake for the first rope that fixates the rope with respect to the load support, and wherein the brake is biased to an active position.

19. The load carrying system according to claim 18, further comprising a second rope that is connected with the brake to release the brake by pulling the second rope with respect to the load support, and wherein an opposite end of the second rope extends outside the load support.

* * * * *